US005317969A

United States Patent [19]

Tateishi

[11] Patent Number: 5,317,969

[45] Date of Patent: Jun. 7, 1994

[54] ENGAGING APPARATUS OF A PRINTING CYLINDER CLEANING UNIT

[75] Inventor: Haruki Tateishi, Itabashi, Japan

[73] Assignee: Nikka Kabushiki Kaisya, Tokyo, Japan

[21] Appl. No.: 897,428

[22] Filed: Jun. 12, 1992

[30] Foreign Application Priority Data

Dec. 18, 1991 [JP] Japan ..... 3-110717[U]

[51] Int. Cl.[5] ..... B41F 35/00; B41L 41/00

[52] U.S. Cl. ..... 101/425; 101/423

[58] Field of Search ..... 101/423–425, 101/247

[56] References Cited

U.S. PATENT DOCUMENTS

| | | | |
|---|---|---|---|
| 3,735,702 | 5/1973 | Kossak | 101/425 |
| 3,771,450 | 11/1973 | Cleybergh | 101/425 |
| 4,384,522 | 5/1983 | Ehlers et al. | 101/247 |
| 4,643,090 | 2/1987 | McKrell et al. | 101/247 |
| 5,010,819 | 4/1991 | Uribe et al. | 101/423 |
| 5,103,730 | 4/1992 | Sarda | 101/425 |
| 5,105,740 | 4/1992 | Loos et al. | 101/424 |
| 5,132,713 | 7/1992 | Christy et al. | 101/247 |
| 5,245,925 | 9/1993 | Switall et al. | 161/423 |

*Primary Examiner*—Edgar S. Burr
*Assistant Examiner*—Lynn D. Hendrickson
*Attorney, Agent, or Firm*—Oliff & Berridge

[57] ABSTRACT

According to the present invention, even when a position of a printing cylinder is changed, a relative distance to a cleaning unit is invariable. Hence, a contact pressure of the cleaning unit with the printing cylinder is always kept constant. Movable plates are supported on a fixed plate and drivable in reciprocation towards and away from the printing cylinder by an actuator. A first movable plate is mounted with a positioning roller capable of rotationally contacting a bearer of the printing cylinder, thereby positioning the cleaning unit mounted on the second movable plate. The second movable plate is provided with a contact pressure adjusting mechanism of the cleaning unit. Even when changing a rotational center of the printing cylinder by the positioning roller rotationally contacting the bearer, the cleaning unit can be always set at a constant contact pressure.

8 Claims, 5 Drawing Sheets

ENGAGING APPARATUS OF A PRINTING CYLINDER CLEANING UNIT

BACKGROUND OF THE INVENTION

1. Field of the Invention

The present invention relates to an engaging apparatus of a printing cylinder cleaning unit and, more particularly, to an engaging apparatus of a printing cylinder cleaning unit which is suited to a case where blanket cylinder of a printing machine takes such a movable structure as to alternately contact an adjacent impression drum and other blanket cylinders.

The cleaning device of the printing cylinder cleans the cylinder surface by making a rotary brush and a cleaning sheet wetted with a cleaning liquid contact with the printing cylinder. For this reason, the cleaning device is contact/separate-driven by the engaging apparatus so that the cleaning device contacts a cylinder drum for a cleaning time but separates from the cylinder drum for a non-cleaning time.

The conventional engaging apparatus includes, as illustrated in FIG. 5, contact/separate operating swing arms 2, disposed at both ends of a cleaning device unit 1, for fixedly holding the unit 1. This swing arm 2 is swingably supported on an unillustrated fixed plate through a rotary support shaft 3. At the same time, an expansion rod of an air cylinder similarly mounted on the fixed plate is connected to this swing arm 2. The swing arm 2 can be thereby swingably driven about the rotary support shaft 3. Then, the swing arm 2 is fitted with a stopper rod 6, and a stopper plate 7 is mounted on the unillustrated fixed plate so that a cleaning portion of a brush or the like of the cleaning device unit 1 properly contacts a cylinder drum 5. With this arrangement, when swinging the swing arm 2 towards the cylinder drum 5 for the purpose of a cleaning operation, the stopper rod 6 impinges on the stopper plate 7, thus effecting a positioning process. In this state, the cleaning portion of the brush or the like is set to contact the cylinder drum 5 at a proper contact pressure. Further, for adjusting the contact pressure, the stopper rod 6 is equipped with an adjusting bolt 8, whereby a contact pressure is arbitrarily settable by adjusting the bolt 8.

A blanket drum to be cleaned rotationally contacts an adjacent impression drum or blanket drum. In the case of a unit equipped with a half deck to change the contact object depending on a print mode, however, the contact object of the blanket drum changes to any one of the impression drum and other blanket drums. In the printing cylinder having a plurality of contact objects during the printing process described above, a rotary shaft core position is varied. It is therefore required that the cleaning device adjusts the position of the engaging apparatus every time the contact changeover is effected. To be specific, when changing the rotational center of the cylinder drum 5, the relative distance to the cleaning device unit 1 varies. This leads to such a problem that the adjusting operation by the above-described adjusting bolt 8 is required each time.

SUMMARY OF THE INVENTION

It is a primary object of the present invention in which the attention is paid to the above-mentioned problems inherent in the prior art to provide an engaging apparatus of a printing cylinder cleaning unit which is capable of making invariable a relative distance to a cleaning device even when a position of a cylinder drum is changed and therefore keeping always constant a contact pressure of the cleaning device with respect to the printing cylinder.

To accomplish the foregoing object, according to one aspect of the present invention, there is provided an engaging apparatus of a printing cylinder cleaning unit, for holding and driving the cleaning unit for cleaning the surface of the printing cylinder so as to contact and separate from the printing cylinder. The engaging apparatus includes movable plates supported on a fixed plate and drivable in reciprocations towards the printing cylinder by an actuator. The movable plate is mounted with a positioning roller capable of rotationally contacting a bearer of the printing cylinder, whereby a cleaning position of the movable plate can be set. The movable plate is provided with a pressing force adjustment slide means of the cleaning unit.

Based on the construction described above, the positioning roller of the movable plate rotationally contacts an outer periphery of the bearer of the printing cylinder. The cleaning unit is fixed to the movable plate. Hence, the cleaning unit is stopped in a contact position of the positioning roller with the bearer by pressing the movable plate against the printing cylinder by means of the actuator. A contact pressure between the cleaning unit and the printing cylinder can be always kept constant. At this time, even when the printing cylinder moves to change a contact object, positioning is set by the contact of the positioning roller of the movable plate with respect to the bearer of the printing cylinder. The contact pressure of the cleaning unit can be also kept constant. Further, the contact pressure is adjustable independently by a slide means and therefore adjustable to an arbitrary pressure.

In such an engaging apparatus according to the present invention, the relative distance to the cleaning device remains unchanged even when changing the position of the cylinder drum. Hence, there is exhibited such an advantageous effect that the contact pressure of the cleaning device with respect to the printing cylinder can be always kept constant.

BRIEF DESCRIPTION OF THE DRAWINGS

Other objects and advantages of the present invention will become apparent during the following discussion taken in conjunction with the accompanying drawings, in which.

DESCRIPTION OF THE PREFERRED EMBODIMENT

A concrete embodiment of an engaging apparatus of a printing cylinder cleaning unit according to the present invention will hereinafter be described in detail with reference to the drawings.

Figure 1:
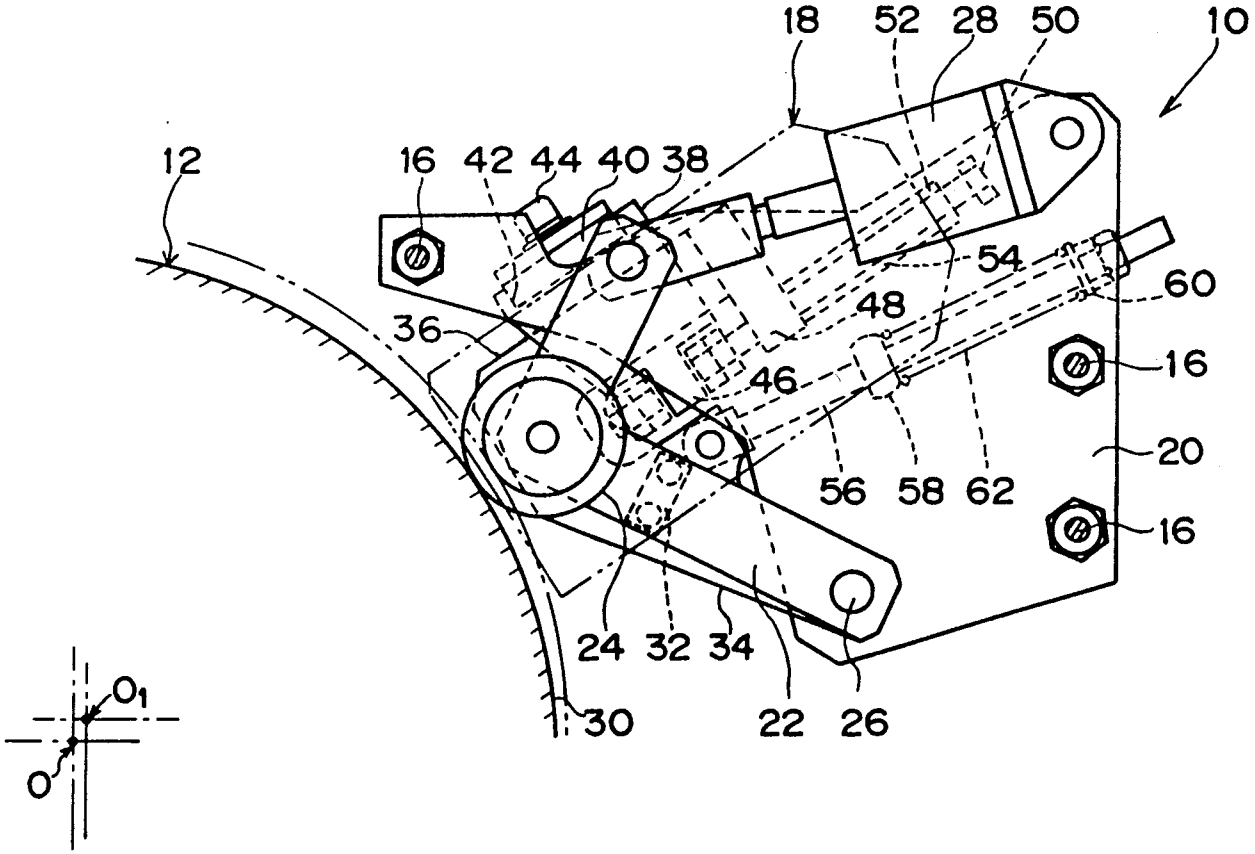
FIG. 1 is a side elevation illustrating an engaging apparatus in an embodiment of the present invention.
Figure 2:
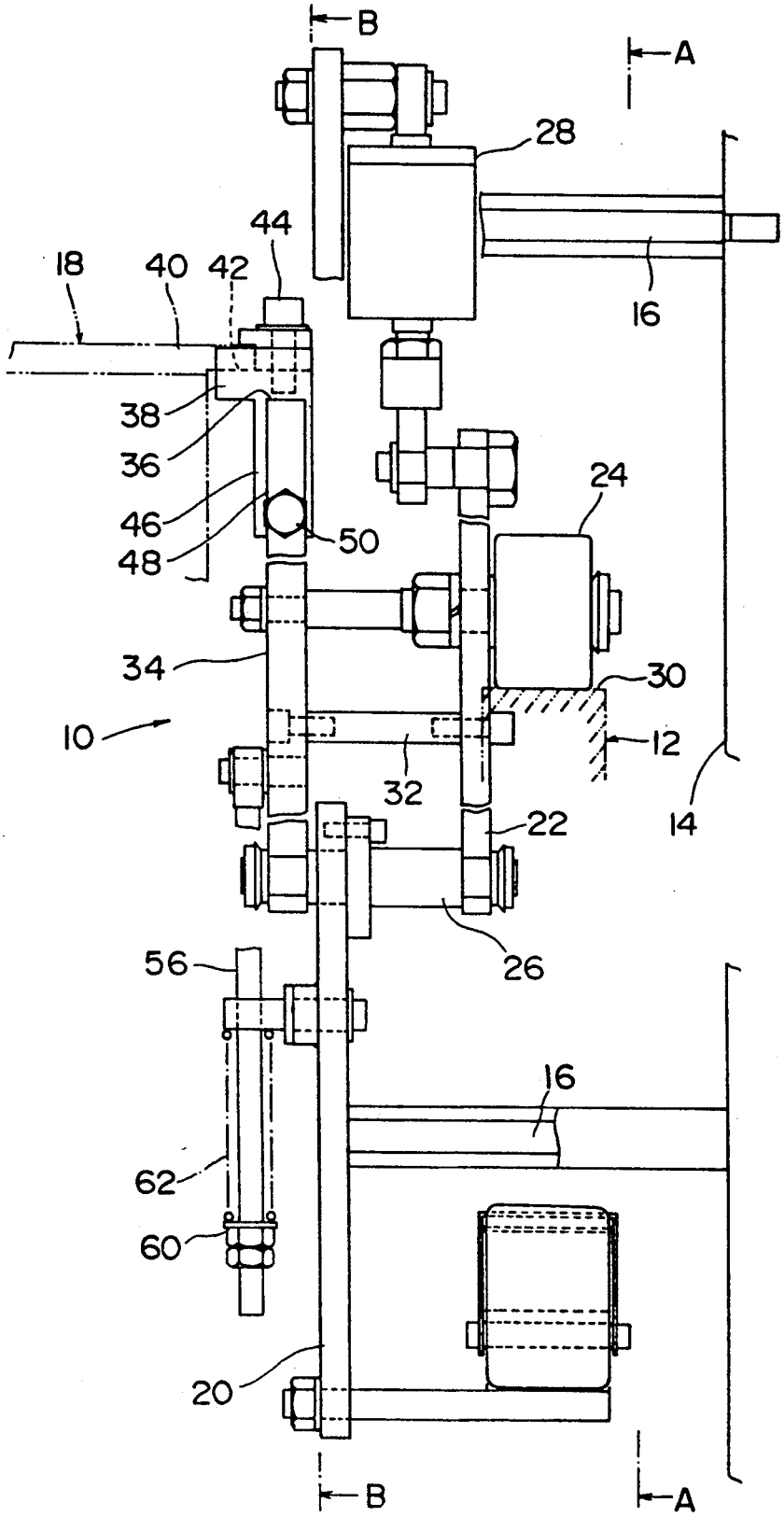
FIG. 2 is a front development elevation showing the same apparatus.
Figure 3:
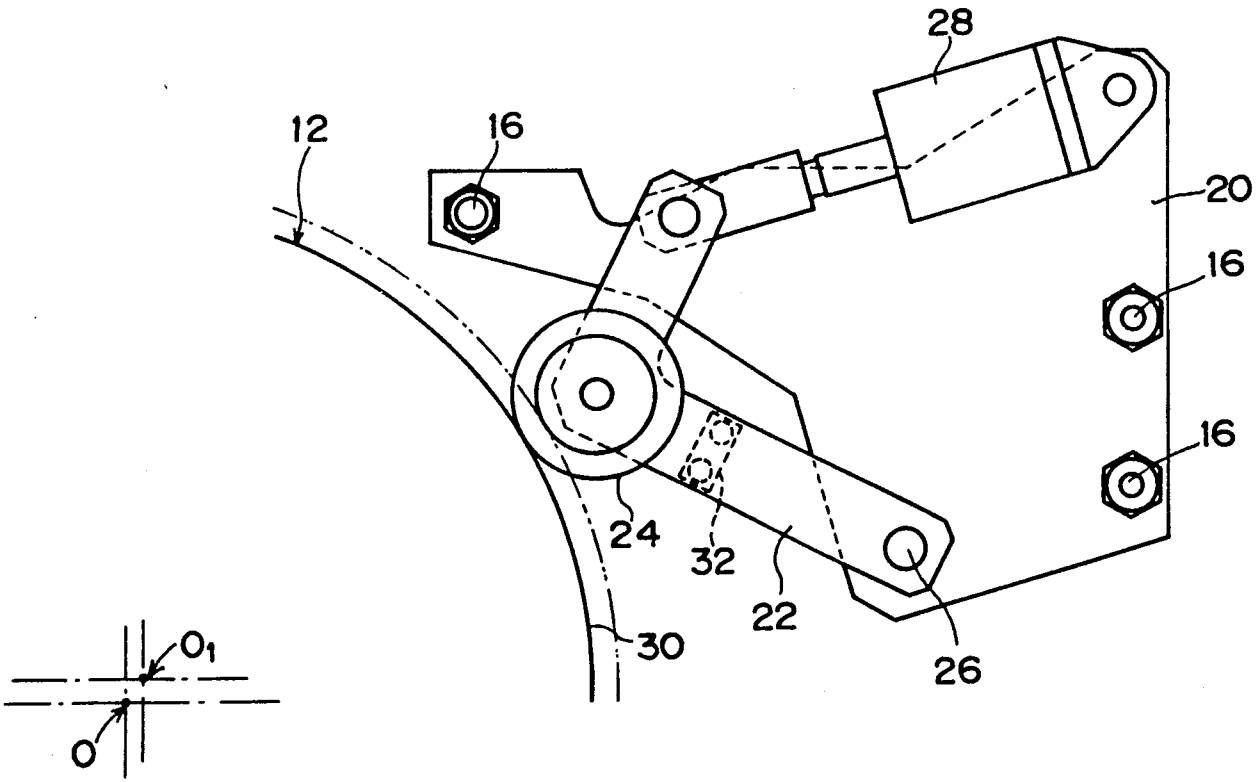
FIG. 3 is an end view taken substantially along the line A—A of FIG. 2.
Figure 4:
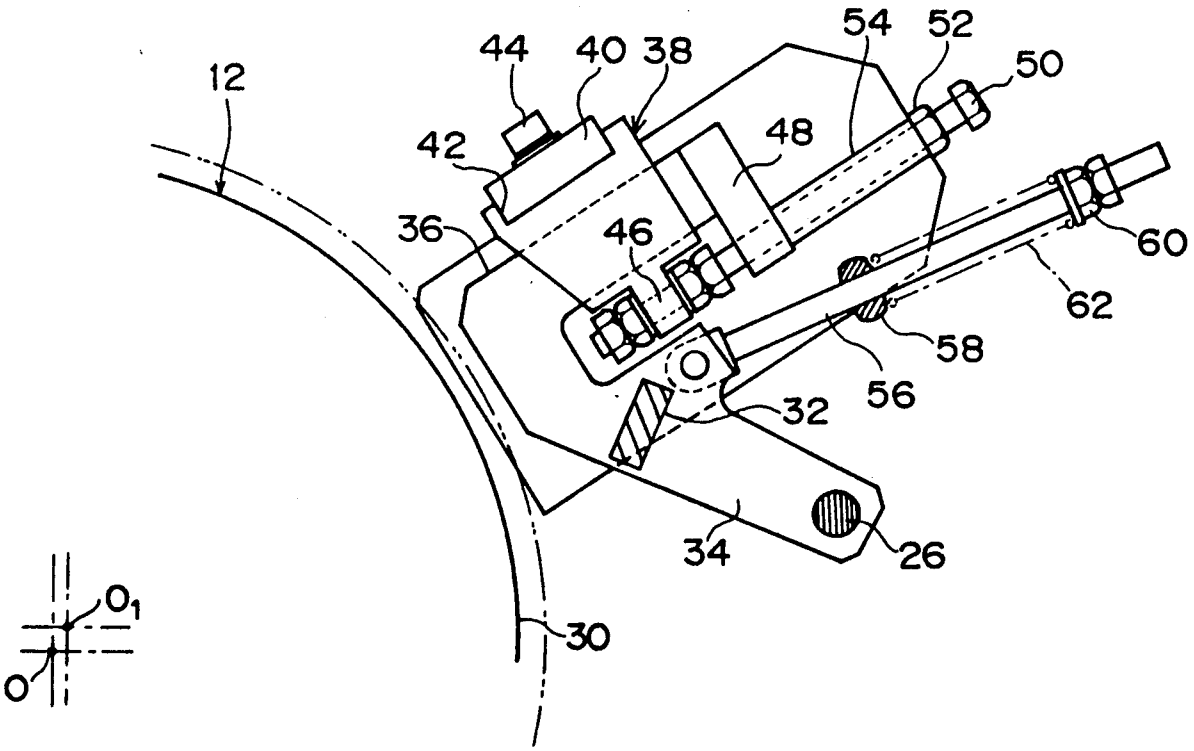
FIG. 4 is an end view taken substantially along the like B—B of FIG. 2.
Figure 5:
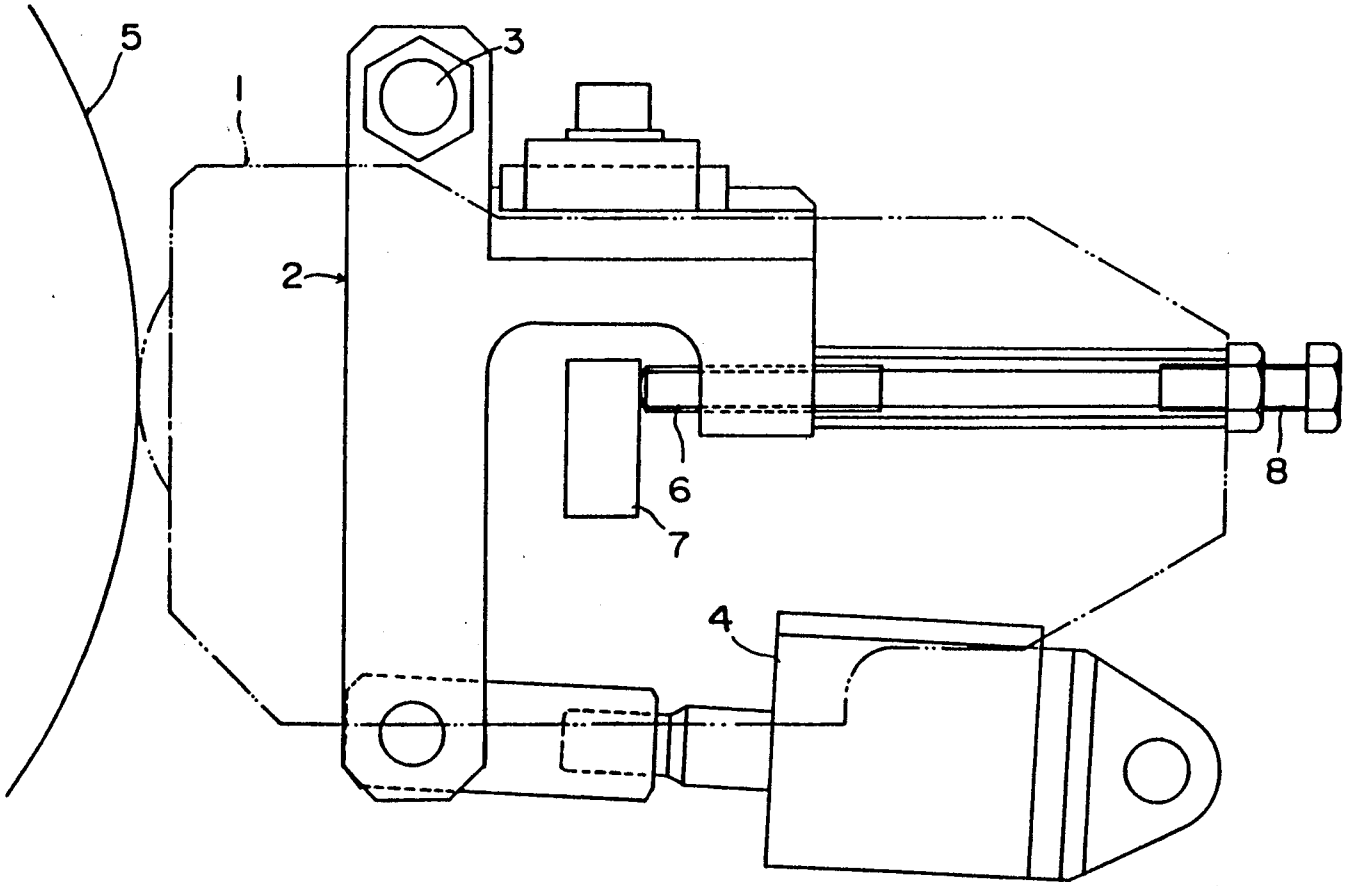
FIG.5 PRIOR ART
FIG. 5 is a side elevation depicting a conventional engaging apparatus.

FIG. 1 is a side view illustrating the engaging apparatus of the printing cylinder cleaning unit in the embodiment. FIG. 2 is a front development elevation showing the same apparatus. Further, FIGS. 3 and 4 are end elevations of assistance in understanding FIG. 1.

As depicted in these Figures, an engaging apparatus 10 is fixed to a frame 14 mounted with a blanket cylinder 12 and equipped with a fixed plate 20 disposed at a side end portion of a cleaning unit 18. A first movable plate 22 which is, as illustrated in FIGS. 1 and 3, bent in an L shape is secured to a single-sided portion of the fixed plate 20. The bent portion of the first movable plate 22 is directed to the blanket cylinder 12. A positioning roller 24 is rotatably fitted to this bent portion. Then, one end of the first movable plate 22 is connected to the fixed plate 20, while the other end thereof is connected to a rod of an air cylinder 28 secured to the fixed plate 20. Hence, the first movable plate 22 is swingably driven about a rotary support shaft 26 by an operation of the air cylinder 28, whereby the positioning roller 24 contacts and separates from an outer peripheral surface of the blanket cylinder 12. In this case, a contact position of the positioning roller 24 with respect to the blanket cylinder 12 exists on a bearer member 30 of the end portion of the blanket cylinder; and the two components rotationally contact each other.

Disposed further on the side of an opposite surface of the fixed plate 20 is a second movable plate 34 linked integrally to the first movable plate 22 through a spacer 32 and sharing the rotary support shaft 26 with the first movable plate 22. With this arrangement, the second movable plate 34 is swingably driveable by an air cylinder 28 together with the first movable plate 22. The thus constructed second movable plate 34 includes a slide guide 36 formed substantially in the radial direction of the blanket cylinder 12. A slider 38 is slidably mounted astride of this guide 36. The slider 38 is intended to fix the cleaning unit. For this purpose, the cleaning unit 18 is provided with a wing plate 40 protruding from a side edge thereof. This wing plate 40 engages with a recess 42 formed in the slide 38 and fixed thereto with a bolt 44. Further, the slider 38 is operable to adjust its movement along the slide guide 36, whereby a contact pressure of the cleaning unit 18 with respect to the blanket cylinder 12 is adjustable.

A contact pressure adjusting mechanism of the cleaning unit 18 is connected to a leg member 46 formed on the slider 38. This mechanism also includes an adjusting bolt 50 penetrating a bracket 48 provided on the second movable plate 34. Then, a spacer sleeve 54 with a lock nut 52 is fixed to the bracket, and the adjusting bolt 50 is screw-inserted thereinto. Therefore, the slider 38 is slid back and forth by controlling a quantity of spiraling advancement of the adjustment bolt 50, thereby adjusting the contact pressure of the cleaning unit 18.

The second movable plate 34 is mounted with a protection means for biasing the second movable plate 34 in such a direction as to separate from the blanket cylinder 12, with the rotary support shaft 26 serving as the center. A shaft 56 connected to the second movable plate 34 is inserted into a rotary pin 58 fitted to the fixed plate 20, and a compression coil spring 62 is stretched between a spring washer 60 provided at the insertion tip end and the rotary pin 58. The movable plate 22, 34 are thereby always biased in such a direction as to separate from the blanket cylinder 12. If the contact pressure by the air cylinder 28 disappears, the cleaning unit 18 prevents the contact with the blanket cylinder 12. This is effective especially in a cleaning device for performing a cleaning operation during rotations of the blanket cylinder 12.

According to the thus constructed engaging apparatus, when effecting the cleaning operation, a constant air pressure is supplied to the air cylinder 28 to perform stretch driving. The first and second movable plates 22. 34 are thereby swayed counterclockwise about the rotary support shaft 26 in FIG. 1. The positioning roller 24 fitted to the first movable plate 22 thereby impinges on the bearer member 30 of the blanket cylinder 12, thus determining a cleaning position of the cleaning unit 18 mounted thereon. In this state, the contact pressure of the cleaning unit 18 is properly preset by the adjusting bolt 50 provided on the side of the second movable plate 34. Hence, a cleaning member such as a rotary brush or the like is brought into such a contact state as to be capable of cleaning the surface of the blanket cylinder 12.

Printing is effected while the blanket cylinder 12 rotationally contacts the impression drum and other blanket cylinders. Now, supposing that the blanket cylinder 12 to be cleaned is constructed to change the rotational contact object, a rotational center 0 of the blanket cylinder 12 shifts, as illustrated in FIG. 1, to $0_1$ by a changing operation. With this shift, the position of the outer peripheral surface of the blanket cylinder 12 also shifts (position of an imaginary line). When such a shift is made, the positioning roller 24 which rotationally contacts the cylinder bearer member 30 follows to swing the movable plates 22, 34. The cleaning unit 18 mounted on the movable plates 22, 34 is so set that the contact pressure with the blanket cylinder 12 is always adequate in the position set by the positioning roller 24. Hence, even when the blanket cylinder 12 moves, the contact pressure is kept constant. Namely, there is no necessity for adjusting the contact pressure of the cleaning unit 18 every time the blanket cylinder 12 moves.

As discussed above, in accordance with the embodiment, even when performing the positional changing operation of the blanket cylinder 12, the necessity for adjusting the cleaning unit 18 is eliminated. The cleaning contact pressure by a rotary brush and an unwoven cloth can be kept constant. The contact pressure is adjustable by moving the slider to and fro which supports the unit 18, and hence there is no obstacle against the adjustment of the cleaning pressure. Besides, even if the air cylinder operates due to a malfunction, because of the follow-up method after the bearer member 30, the cleaning unit 18 does not deface the surface of the blanket cylinder 12.

In the embodiment discussed above, the positioning roller 24 which rotationally contacts the bearer member 30 takes such a structure that Nylon resin is fusion-welded onto the outer peripheral surface with a consideration so as not to cause frictions of the bearer member 30.

Note that the above-described embodiment gives a constructive example where the movable plates 22, 34 are swingably driven. These plates can be also constructed to make contact/separating operations by providing an adequate linear guide to attain a linear drivable state in the radial direction of the blanket cylinder 12. Furthermore, the cleaning object includes not only the blanket cylinder 12 but also the impression drum.

Although the illustrative embodiment of the present invention has been described in detail with reference to the accompanying drawings, it is to be understood that the present invention is not limited to this embodiment. Various changes or modifications may be effected by one skilled in the art without departing from the scope or spirit of the invention.

What is claimed is:

1. An engaging apparatus of a printing cylinder cleaning unit having a cleaning member, the apparatus holding and driving said cleaning unit for cleaning the surface of a printing cylinder so as to contact and separate said cleaning member from said printing cylinder, said apparatus comprising:

movable plates supported on a fixed plate and being reciprocated towards and away from said printing cylinder by an actuator;

a positioning roller mounted on one of said movable plates and rotationally contacting a bearer of said printing cylinder, said positioning roller defining a cleaning position of said cleaning unit; and adjusting means for adjusting a contact pressure of said cleaning member with respect to said printing cylinder, said adjusting means being mounted on one of said movable plates.

2. The engaging apparatus of the printing cylinder cleaning unit as set forth in claim 1, wherein said movable plates comprise a first movable plate disposed on one side of said fixed plate, said positioning roller being mounted to said first movable plate; and a second movable plate disposed on an opposite side of said fixed plate, said second movable plate holding said cleaning unit.

3. The engaging apparatus of the printing cylinder cleaning unit as set forth in claim 1, further comprising a spring connected between one of said movable plates and said fixed plate for biasing said movable plates to separate from said printing cylinder.

4. An engaging apparatus of a printing cylinder cleaning unit having a cleaning member, the apparatus holding and driving said cleaning unit for cleaning a surface of a printing cylinder so as to contact and separate said cleaning member from said printing cylinder, said apparatus comprising:

a first movable plate supported on one side of a fixed plate and being reciprocated towards and away from said printing cylinder by an actuator;

a second movable plate disposed on an opposite side of said fixed plate and fixedly attached to said first movable plate, said second movable plate holding said cleaning unit;

a positioning roller mounted adjacent said first movable plate and rotationally contacting a bearer of said printing cylinder, said positioning roller defining a cleaning position of said cleaning unit; and a contact pressure adjusting means mounted on said second movable plate for adjusting a contact pressure of said cleaning member, said contact pressure adjusting means comprising a slider fixedly attached to said cleaning unit, said slider being slidably mounted on a slide guide provided on said second movable plate, said adjusting means further comprising an adjusting bolt threadedly attached to said slide guide and said slider, wherein rotation of said adjusting bolt provides relative movement between said slide guide and said slider thereby adjusting the contact pressure of said cleaning member.

5. An engaging apparatus of a printing cylinder cleaning unit having a cleaning member, the apparatus holding and driving said cleaning unit for cleaning a surface of a printing cylinder so as to contact and separate said cleaning member from said printing cylinder, said apparatus comprising:

a first movable plate supported on one side of a fixed plate and being reciprocated towards and away from said printing cylinder by an actuator;

a second movable plate disposed on an opposite side of said fixed plate and fixedly attached to said first movable plate, said second movable plate holding said cleaning unit;

a positioning roller mounted adjacent said first movable plate and rotationally contacting a bearer of said printing cylinder, said positioning roller defining a cleaning position of said cleaning unit; and a contact pressure adjusting means mounted on said second movable plate for adjusting a contact pressure of said cleaning member, said contact pressure adjusting means comprising a slider fixedly attached to said cleaning unit, said slider being slidably mounted on a slide guide provided on said second movable plate, said adjusting means further comprising an adjusting bolt threadedly attached to said slide guide and said slider, wherein rotation of said adjusting bolt provides relative movement between said slide guide and said slider thereby adjusting the contact pressure of said cleaning member; and a spring connected between said second movable plate and said fixed plate for biasing said first and second movable plates to separate from said printing cylinder.

6. The engaging apparatus of the printing cylinder cleaning unit as set forth in claim 1, wherein said adjusting means comprises a slider fixedly attached to said cleaning unit, said slider being slidably mounted on a slide guide provided on one of said movable plates, said adjusting means further comprising an adjusting bolt threadedly attached to said slide guide and said slider, wherein rotation of said adjusting bolt provides relative movement between said slide guide and said slider thereby adjusting the contact pressure of said cleaning member.

7. The engaging apparatus of the printing cylinder cleaning unit as set forth in claim 3, wherein said actuator reciprocates said movable plates towards said printing cylinder over the biasing force of said spring.

8. The engaging apparatus of the printing cylinder cleaning unit as set forth in claim 5, wherein said actuator reciprocates said movable plates towards said printing cylinder over the biasing force of said spring.

* * * * *